United States Patent [19]

Teruyama

[11] 4,265,602

[45] May 5, 1981

[54] GEAR PUMP WITH LOW PRESSURE SHAFT LUBRICATION

[75] Inventor: Hideo Teruyama, Shobu, Japan

[73] Assignee: Kayabakogyokabushikikaisha, Tokyo, Japan

[21] Appl. No.: 960,940

[22] Filed: Nov. 15, 1978

[51] Int. Cl.[3] ..... F04C 2/18; F04C 15/00

[52] U.S. Cl. ..... 418/1; 418/102

[58] Field of Search ..... 418/1, 75, 79, 81, 102, 418/131, 132

[56] References Cited

U.S. PATENT DOCUMENTS

| | | | |
|---|---|---|---|
| 1,927,749 | 9/1933 | Kimmig | 418/102 |
| 2,276,107 | 3/1942 | Simons | 418/102 |
| 2,986,096 | 5/1961 | Booth et al. | 418/102 |
| 3,490,382 | 1/1970 | Joyner | 418/102 |
| 3,528,756 | 9/1970 | Norlin et al. | 418/102 |

FOREIGN PATENT DOCUMENTS

| | | | |
|---|---|---|---|
| 563101 | 11/1932 | Fed. Rep. of Germany | 418/102 |
| 360335 | 11/1931 | United Kingdom | 418/102 |
| 1182608 | 2/1970 | United Kingdom | 418/102 |

*Primary Examiner*—John J. Vrablik

*Attorney, Agent, or Firm*—Saul Jecies

[57] ABSTRACT

At least one pair of intermeshing impeller gears are supported by bearings such as bushings or roller bearings. Liquid drawn through the suction port is forced first to flow perpendicular to the axes of the gears toward one ends of the shafts or trunions thereof and then through a low pressure passage extended in parallel with the axes of the gears and communicated with the pump chamber in opposed relationship with the zone where the teeth of the gears are disengaging. Each bearing is formed with a lubrication or oil groove or passage. One port or end remote from the side face of the gear of the lubrication or oil groove is communicated with the low pressure passage at the closed end thereof or at a position adjacent to the inlet thereof through a passage while the other port or end is communicated through a passage with the low pressure passage at a position between the inlet and closed end thereof. Part of the liquid under low pressure drawn is forced to circulate through these passages and lubrication or oil grooves from the points adjacent to the inlet to the low pressure passage and at the closed end thereof to the points between the inlet and closed end thereof, whereby the bearings and shafts supported thereby may be lubricated and cooled.

5 Claims, 5 Drawing Figures

3
4
19
20
18
21
17
10
29
27
11
50
46
30
34
54
67
59
47
51
55
2
62
23
41
24
63
58
68
37
33
60
64
36
26
39
25
35
43
61
53
57
56
47
69
70
31
52
32
38
13
16
46
22
28
32a
18
15
19
12
20
3
4

40
12
10
16
13
42
27
44
11
30
24
35
55
46
25
47
21
56
52
46
51
62
47
59
26
41
43
28
34
63
16
15
39

GEAR PUMP WITH LOW PRESSURE SHAFT LUBRICATION

BACKGROUND OF THE INVENTION

The present invention relates to a low pressure lubrication system for a gear pump of the type wherein the suction port is opened in the side wall of the cover or mounting plate securely attached to the casing having a pump chamber and more particularly a low pressure lubrication and cooling system for a gear pump wherein part of the liquid drawn and flowing through a low pressure passage which is first extended at right angles to the axes of the intermeshing gears towards one ends of the shafts or trunions thereof and then bent to extend in parallel with the axes of the gears, is circulated to lubricate and cool the rubbing surfaces of the shafts and their bearings.

The same inventor has disclosed the low pressure lubrication system in U.S. Pat. No. 4,090,820. This system is applied to a gear pump of the type wherein both the suction and discharge ports are extended through the casing with the pump chamber at right angles to the axes of the meshing gears. Liquid under low pressure drawn through the suction port is used for lubricating and cooling the shafts of the gears.

In the case of the gear pumps with the suction port formed in the side wall of the cover or mounting plate, the liquid drawn through the suction port is redirected to flow through a low-pressure passage extending in parallel with the axes of the gears, into the spaces between the teeth of the gears. With the low pressure lubrication system of the type disclosed in the above patent, it is therefore extremely difficult to direct the liquid under low pressure especially towards the shafts of the gears at the upstream of the liquid because of the reasons to be described below. First, the above lubrication system utilizes the kinetic energy of liquid under low pressure which is drawn through the suction port and impinges against the teeth of the gears, in order to force part of the liquid into the low pressure chambers. In the case of the gear pumps to which the present invention is applied, the liquid under low pressure flows in parallel with the teeth of the gears and is trapped in the spaces between the teeth. Therefore when the above low pressure lubrication system is applied to these gear pumps, the low pressure chambers at the upstream of the liquid under low pressure are opened toward the downstream so that it becomes impossible to force part of the liquid under pressure into the low pressure chambers at the upstream by the use of the kinetic energy of the liquid under low pressure.

In order to apply the above lubrication system, the low pressure passage must be further bent at right angles so that the liquid under low pressure may impinge forcefully against the tooth surfaces. However, this arrangement would result in the complicated structure and the increase in resistance to the flow of liquid under low pressure. As a result, the pumping capacity would be considerably decreased as compared with the gear pumps of comparable sizes.

SUMMARY OF THE INVENTION

Accordingly, one of the object of the present invention is to provide a low pressure lubrication system which may satisfactorily lubricate and cool the shafts of a pair of intermeshing gears with liquid under low pressure in a gear pump of the type wherein a suction port is opened in the side wall of the cover or mounting plate and the liquid drawn through the suction port is redirected to flow through a low pressure passage extended in parallel with the axes of the gears or the tooth surfaces thereof.

According to one embodiment of the present invention, a gear pump has at least one pair of intermeshing impellers or gears whose shafts or trunions are rotatably supported by bearings. As the gears are rotated, the liquid under low pressure is drawn through the suction port and flows at right angles to the axes of the trunions of the gears towards one ends thereof. Thereafter the liquid is redirected to flow through a low pressure passage extended in parallel with the axes of the trunions of the gears and impounded in the spaces between the teeth of the gears.

Each of the bearings supporting the trunions of the gears is formed with an axially extended lubrication or oil groove or passage. Ports or one ends of these lubrication or oil grooves remote from the side faces of the gears are communicated through passages with the low pressure passage at the points adjacent to the inlet thereof and at the closed end thereof. Ports or the other ends closer to the side faces of the gears of the lubrication or oil grooves are communicated through passages with the low pressure chamber or passage at the points between the inlet and closed end thereof. Therefore, part of the liquid under low pressure drawn through the suction port and flowing in the direction at right angles to the axis of the trunions of the gears is forced to flow through the passages, which open adjacent to the inlet to the low pressure passage, into the lubrication or oil grooves of the bearings supporting the trunions of the gear at the upstream of the liquid under low pressure. After having lubricated and cooled the rubbing surfaces of the bearings and trunions, the liquid is returned through the passages to the low pressure passage at the points between the inlet and closed end thereof. In like manner, part of the liquid redirected to flow through the low pressure passage extended in parallel with the axes of the trunions is forced, under the kinetic energy of the flowing liquid, to flow through the passages into the lubrication or oil grooves of the bearings at the downstream. After having lubricated and cooled the rubbing surfaces of the trunions and their bearings, the liquid is returned through the passages to the low pressure passage at the points between the inlet and closed end thereof. Since the axis of each passage communicating with the lubrication or oil groove is in parallel with the direction of the flow of liquid under low pressure both at the suction port and low pressure passage, part of liquid under low pressure is positively made to flow into the communication passage.

While the liquid flows through the lubrication or oil grooves, it lubricates and cools effectively the rubbing surfaces of the shafts and their bearings and then is returned through the passages to the low pressure passage at the points between the inlet and closed end thereof as described above. Therefore the seizure between the trunions and their bearings may be completely avoided.

The above and other objects, features and advantages of the present invention will become more apparent from the following description of two preferred embodiments thereof taken in conjunction with the accompanying drawings.

BRIEF DESCRIPTION OF THE DRAWINGS

Same reference numerals are used to designate similar parts throughout FIGS. 1-4, and in FIG. 1 those parts similar to those of the first embodiment shown in FIGS. 1-4 are designated by reference numerals each consisting of the reference numeral of a similar part in the first embodiment plus 100.

DESCRIPTION OF THE PREFERRED EMBODIMENTS

First Embodiment, FIGS. 1-4

Figure 1:
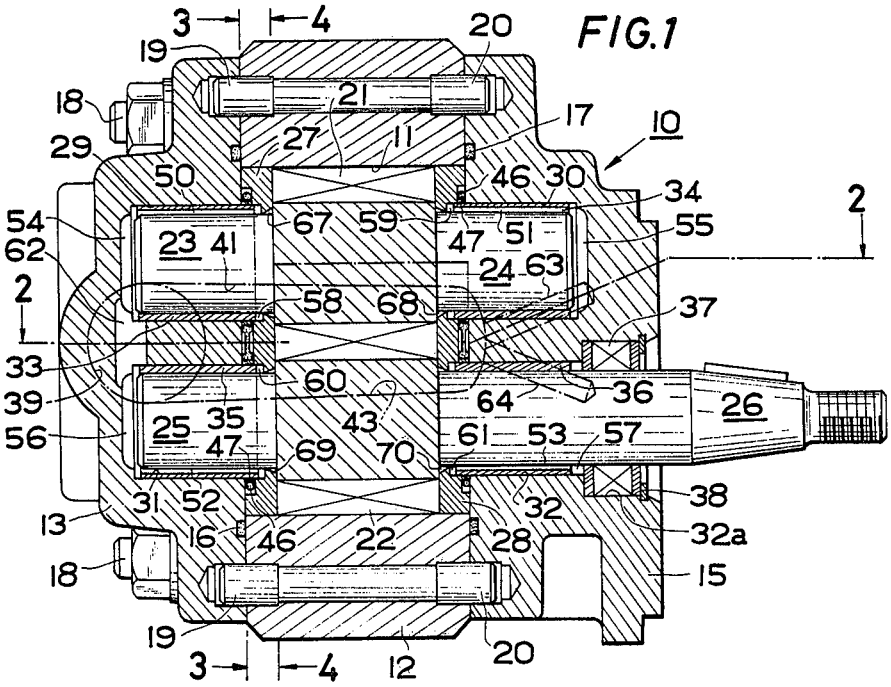
FIG. 1 is a longitudinal sectional view of a first embodiment of a gear pump in accordance with the present invention.
Figure 2:
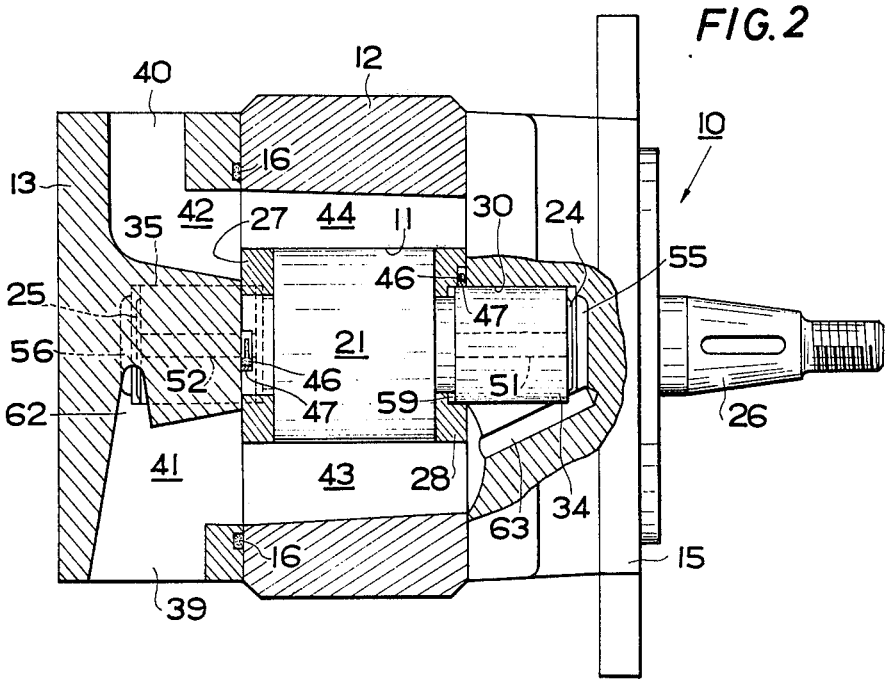
FIG. 2 is a sectional view taken along the line 2—2 of FIG. 1.
Figure 3:
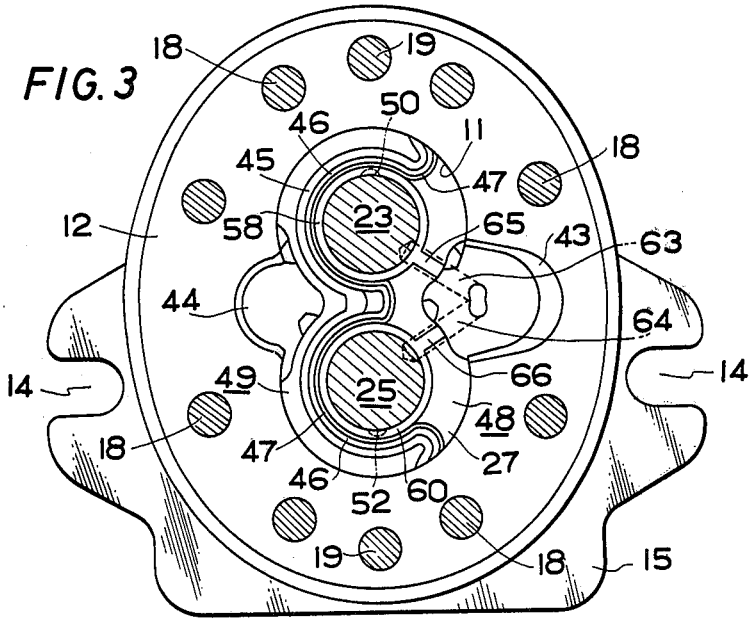
FIG. 3 is a sectional view taken along the line 3—3 of FIG. 1.

Referring to FIGS. 1-3, a gear pump 10 in accordance with the present invention comprises, in general, a housing consisting of a casing 12 with a figure 8-shaped pump cavity or chamber 11 and end plates, more particularly a cover plate member 13 and mounting plate member 15 with mounting notches 14; and a pair of intermeshing impellers 21 and 22 in the form of gears and disposed for rotation within the pump chamber 11. When the casing 12, the cover plate member 13 and the mounting plate member 15 are assembled together with bolts 18, body seals 16 and 17 are interposed between the casing 12 and the cover and mounting plate members 13 and 15. Dowel pins 19 and 20 serve to align between the cover and mounting plate members 13 and 15.

The gears 21 and 22 which are disposed in the pump chamber 11 for rotation in mesh with each other have trunions 23,24,25 and 26 which are rotatably fitted into bushings 33,34,35 and 36, respectively, which serve as the bearings and are fitted into trunion receiving holes 29,30, 31 and 32 formed in the cover and mounting plate members 13 and 15. In order to provide the liquid-tight sealing between the casing 12 and the side faces of the gears 21 and 22, pressure plates 27 and 28 are axially slidably fitted into the pump chamber 11 and pressed against the side faces of the gears 21 and 22.

The shaft 26 of the gear 22 is extended through the mounting plate member 15 and coupled to the drive shaft of a prime mover (not shown). In order to provide the liquid-tight sealing of the driven shaft 26, an oil seal 37 is fitted over the shaft 26 and is retained in an enlarged recess 32*a* at the outer end of the hole 32 under the force of a snap ring 38.

Figure 4:
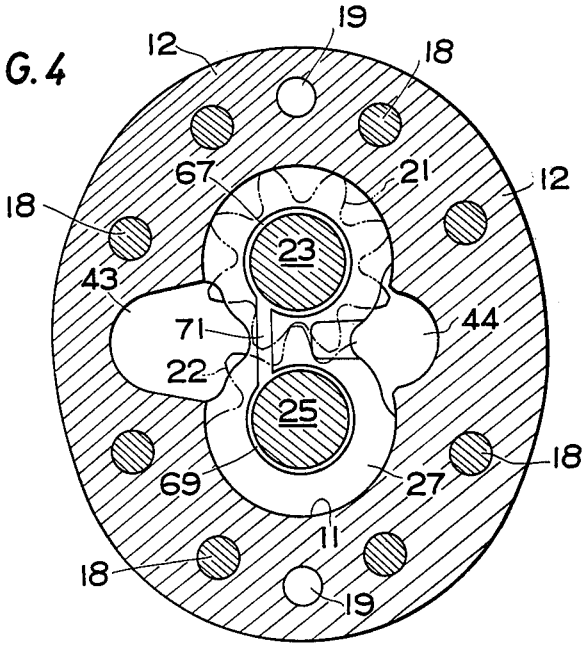
FIG. 4 is a sectional view taken along the line 4—4 of FIG. 1.

In the first embodiment, a suction port 39 and a discharge port 40 are formed in the cover plate member 13 and are located at right angles to the axes of the intermeshing gears 21 and 22 as best shown in FIG. 2. That is, the axes of the suction and discharge ports 39 and 40 are at right angles to the centerline between and in parallel with the axes of the trunions 23 and 25 of the gears 21 and 22 and are directed toward the left or free ends (that is, one ends) of the trunions 23 and 25. The intake port 39 is communicated with a first low pressure passage 41 which is an extension of the intake port 39 and in turn is communicated with a second low pressure passage 43 extended through the casing 12 in parallel with the axes of the gears 21 and 22 and communicated with the pump chamber 11. In like mannner, the discharge port 40 is communicated with a first high pressure passage 42 which is an extension of the discharge port 40 and in turn is communicated with a second high pressure passage 44 extended through the casing 12 in parallel with the axes of the gears 21 and 22 and communicated with the pump chamber 11. The openings to the pump chamber 11 of these second low and high pressure passages 43 and 44 are in opposed relationship with the disengaging and engaging teeth of the gears 21 and 22 as best shown in FIG. 4.

The pressure plates 27 and 28 are configured so as to be snugly fitted into the pump chamber 11 and are substantially similar in construction. Furthermore, they are mounted in symmetrical relationship with each other. Therefore it will suffice to explain the left-hand side pressure plate 27.

Referring particularly to FIG. 3, the outside surface of the pressure plate 27; that is, the surface opposite to the surface in contact with the side faces of the gears 21 and 22, is formed with a curved groove 45 in the form of an inverted 3. A seal 46 also in the form of an inverted 3 is fitted into the groove 45 together with a back-up member 47. The seal 46 divides the outside surface of the pressure plate 27 into the low pressure zone 48 and the high pressure zone 49 which are communicated with the first and second low pressure passages 41 and 43 and with the first and second high pressure passages 42 and 44 as will be described in more detail below.

Referring back to FIGS. 1-4, as the driven shaft 26 is rotated, the spaces between the teeth of the gears 21 and 22 pass the suction opening of the second low pressure passage 43 so that liquid is impounded between them and carried around the casing 12 to the discharge opening of the second high pressure passage 44. Thus the liquid under low pressure drawn through the suction port 39 and the first and second low pressure passages 41 and 43 is pressurized and discharged through the second and first high pressure passages 44 and 42 and the discharge port 40.

When the pump is operating, the pressure in the low pressure zone 48 of the pressure plate 27 is low because the pressure zone 48 is in communication with the first and second low pressure passages 41 and 43. On the other hand, the pressure in the high pressure zone 49 is high because the high pressure zone 49 is communicated with the first and second high pressure passages 42 and 44. Therefore, the pressures acting on the pressure plate 27 are balanced. The force of pressure under which the pressure plate 27 is pressed against the side faces of the gears 21 and 22 is dependent upon the ratio in area between the low and high pressure zones 48 and 49. Thus the side faces of the gears 21 and 22 may be optimumly liquid sealed.

Next the low-pressure liquid lubrication and cooling means for the trunions and driven shaft 33-36, which is the most important object of the present invention, will be described. Referring to FIG. 1-3, the bushings 33-36 are provided with lubrication grooves 50,51,52 and 53, respectively, which extend axially in the inside walls thereof. The outer ends of these lubrication grooves 50-53 are communicated with the chambers 54,55,56 and 57, respectively, defined between the bottoms of the holes 29–32 of the cover and mounting plate members 13 and 15 on the one hand and the free ends of the trunions 23–26 of the gears 21 and 22 on the other hand. The inner ends of the lubrication grooves 50–53 are communicated with the annular grooves or passages 58,59,60 and 61, respectively, defined between the inner ends (on the side of the faces of the gears 21 and 22) of the bushings 33–36 and the recesses formed in the outer surfaces of the pressure plates 27 and 28.

The chambers 54 and 56 which are communicated with the lubrication grooves 50 and 52 (on the left-hand side) are communicated with the first low pressure passage 41 through a passage 62 which is extended inwardly in parallel with the axis of the first low pressure passage 41. The chambers 55 and 57 which are communicated with the lubrication grooves 51 and 53, respectively, are communicated with the second low pressure chamber 43 at the closed end thereof (the right-hand side) through passages 63 and 64, respectively.

The annular passages 58 and 60 which are communicated with the outer ends of the lubrication grooves 50 and 52 are communicated with the second low pressure passage 43 through grooves 65 and 66, respectively, formed in the outside surface of the pressure plate 27. In like manner, the annular grooves 59 and 61 which are communicated with the inner ends of the lubrication grooves 51 and 53 (on the right-hand side) are also communicated with the second low pressure passage 43 through the grooves (not shown) formed in the outside surface of the pressure plate 28.

Thus, four lubricating and cooling liquid circulation passages or paths are established. A first circulation passage consists of the first low pressure passage 41, the passage 62, the chamber 54, the lubrication groove 50 extended axially through the bushing 33, the annular passage 58, the groove 65 in the pressure plate 27, and the second low pressure passage 43 which is communicated with the first low pressure passage 41. In like manner, a second circulation passage consists of the first low pressure passage 41, the passage 62, the chamber 56, the lubrication groove 52 extended axially through the bushing 35, the annular groove 60, the groove 66 formed in the outside surface of the pressure plate 27 and and the second low pressure passage 43. A third circulation passage consists of the second low pressure passage 43, the passage 63, the chamber 55, the lubrication groove 51 extended through the bushing 34, the annular groove 59, and the groove formed in the outside surface of the pressure plate 28 and communicated with the second low pressure passage 43. In like manner, a fourth circulation passage consists of the second low pressure passage 43, the passage 64, the chamber 57, the lubrication groove 53 extended through the bushing 36, the annular groove 61, the groove (now shown) formed in the outside surface of the pressure plate 27 and communicated with the second low pressure passage 43.

When the pump 10 is driven, the liquid under low pressure is drawn through the suction port 39 into the first low pressure passage 41. Because of the kinetic energy of the liquid drawn, part of it is forced to flow through the passage 62 into the chambers 54 and 56. As the liquid is further drawn through the first and second low pressure passages 41 and 43 in parallel with the axes of the gears 21 and 22, part of it is forced to flow through the passages 63 and 64 into the chambers 55 and 57. From the chambers 54–57, the liquid flows through the lubrication grooves 50–53 extended through the bushings 33–36 toward the annular grooves or passages 58–61. Thus the liquid may lubricate the rubbing surfaces of the trunions 23–26 of the gears 21 and 22 and the bushings 33–36 while removing the heat therefrom. The liquid discharged into the annular grooves 58–61 is returned to the second low pressure passage 43 through the grooves 65 and 67 formed in the outside surface of the pressure plate 27 and the grooves (now shown) formed in the outside surface of the pressure plate 28.

Thus, the rubbing surfaces of the bushings 33–36 and the trunions 23–26 of the gears 21 and 22 may be effectively lubricated and cooled with the low pressure liquid circulated on the low pressure side of the gear pump 10 in the manner described above, whereby seizure between them may be avoided completely.

So far the lubrication grooves 50–53 extended through the bushings 33–36 have been described as being straight, but it is to be understood that they may be of any other suitable forms. For instance, they may be spiral grooves. Furthermore, the provision of these lubrication or oil grooves 50–53 may be completely eliminated because during the operation of the gear pump 10, both the intermeshing gears 21 and 22 are pressed toward the second low pressure passage 43 due to the pressure difference the low- and high-pressure passages 43 and 44 so that the trunions 23–26 are forced toward the walls of the bushings 33–36 closer to the second low pressure passage 43, thus leaving the spaces between the trunions 23–26 and the bushings 33–36 through which the lubricating and cooling liquid may flow.

The liquid trapped the spaces between the teeth of the gears 21 and 22 especially adjacent to the roots of the teeth and returned from the high pressure side 44 to the low pressure side 43 is heated. The leakage of the heated liquid into the second low pressure passage 43 will adversely affect the lubrication and cooling of the trunions 23–26 of the gears 21 and 22 and their bushings 33–36, resulting in the decrease in efficiency of the gear pump 10. This problem becomes more serious especially when the pump 10 must handle liquid under high pressure.

In order to overcome this problem, according to the present invention, annular grooves 67,68,69 and 70 (See FIG. 1) are formed in the inside surfaces of the pressure plates 27 and 28 in opposed relationship with the side faces of the gears 21 and 22 and are physically separated from the annular grooves or passages 58–61 defined in the outside surfaces of the pressure plates 27 and 28. Alternatively, they may be formed in the trunions 23–26 of the gears 21 and 22 adjacent to the roots thereof. These annular grooves 67–70 are communicated with the second low pressure passage 43 through grooves 71 (See FIG. 4) formed in the inside surfaces of the pressure plates 27 and 28.

Therefore, the liquid under high pressure which leaks from the roots of the teeth of the gears 21 and 22 during the operation to the gear pump 10 is trapped in the annular grooves 67–70 and then returned through the grooves 71 to the second low pressure passage 43. Thus, the direct leakage of the liquid under high pressure and at relatively high temperatures into the lubricating and cooling liquid circulation passages may be completely avoided, whereby the effective and efficient lubrication and cooling may be ensured.

Figure 5:
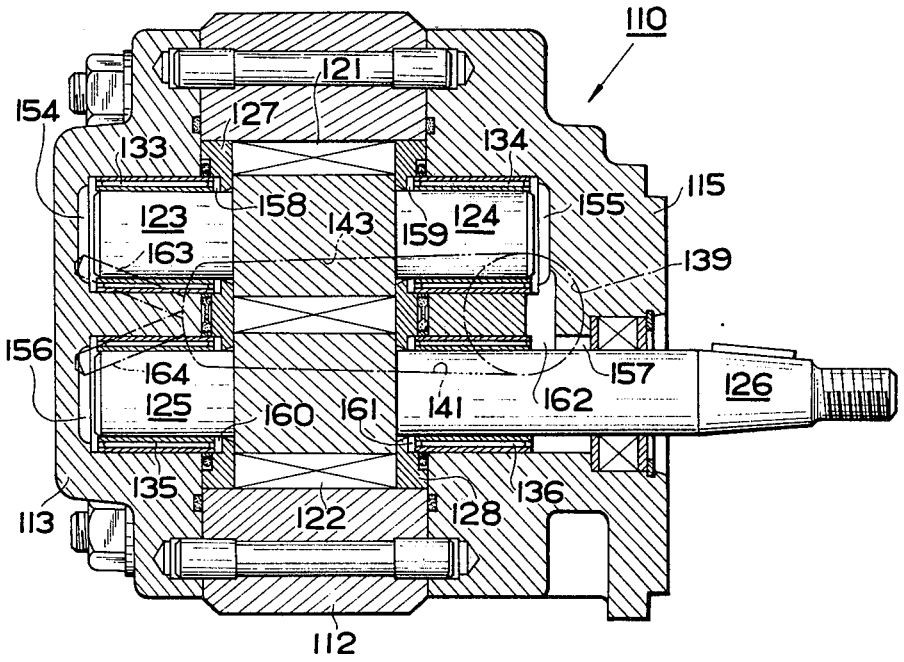
FIG. 5 is a longitudinal sectional view of a second embodiment of a gear pump in accordance with the present invention.

Second Embodiment, FIG. 5

The second embodiment shown in FIG. 5 is substantially similar in construction to the first embodiment described above in conjunction with FIGS. 1–4 except that the suction port 139 and the first low pressure passage 141 are formed in the mounting plate member 115 and that the right-hand side chambers 155 and 157 are communicated through the passage 162 with the second low pressure passage 141 while the left-hand side chambers 154 and 156 are communicated through the passage 163 and 164 with the second low pressure passage 143. Since the construction and mode of operation of the second embodiment may be easily understood from the explanation of the first embodiment, the following explanation will suffice.

In the second embodiment, instead of the bushings, roller bearings 133,134,135 and 136 are used for supporting the shafts 123,124,125 and 126 of the gears 121 and 122. These roller bearings, which belong to the bearings with rolling contact differentiated from the plain bearings, have spaces between their rollers as is well known in the art so that opposed to the first embodiment provided with the lubrication or oil grooves, they are not needed at all.

It is to be understood that the present invention may be equally applied to the gear pump of the type disclosed in U.S. Pat. No. 4,090,820, granted Hideo Teruyama, May 23, 1978. In this gear pump, the pressure plates 27 and 28 or 127 and 128 are not used and instead the bushings capable of the pressure loading are used for supporting the trunions or shafts of the gears. In this case, the low pressure zones at the rear ends of these bushings may be used as the passages consisting of the low pressure lubrication passages.

What is claimed is:

1. A method of lubricating trunnions and bearings of a gear pump, comprising the steps of rotating gears of said gear pump in such a way that liquid under low pressure may be drawn through a low pressure port extended substantially at right angles to the axes of gear trunnions toward one end thereof and then be redirected to flow through a low pressure passage extended in parallel with said axes of said trunnions so as to be impounded in the spaces between the teeth of said gears; and utilizing the kinetic energy due to the flow velocity of said liquid under low pressure in such a way that part of said liquid under low pressure may be forced into lubrication or oil passages through communication passages which open at the closed end of said low pressure port adjacent to the inlet to said low pressure passage and at the closed end of said low pressure passage and return said liquid under low pressure to said low pressure passage after it has been distributed to bearings of said gears, thereby effecting forced lubrication and cooling of said trunnions of said gears.

2. In a gear pump, a combination comprising a housing having a pump chamber, at least one pair of meshing gears mounted for rotation in said pump chamber and each having two axially spaced trunnions, bearings mounted in said housing for supporting said trunnions for rotation, a low pressure liquid inlet passage having a low pressure port and a high pressure port formed in said housing and consisting of a suction passage extended from said low pressure port substantially at right angles to the axes of said trunnions toward one end thereof and a low pressure passage which is communicated with said suction passage at a portion adjacent to the closed end thereof and is extended in parallel with the axes of said trunnions, motor means for rotating said gears so that liquid under low pressure may be drawn through said low pressure liquid inlet passage, impounded in the spaces between the teeth of said gears, pressurized and discharged through said high pressure port, communication passages branched from said low pressure liquid inlet passage so that the kinetic energy due to the flow velocity of said liquid under low pressure flowing through said low pressure inlet passage forces part of said liquid under low pressure into said branched communication passages, and liquid channelling means for channelling said liquid under low pressure forced into said branched communication passages to said bearings so as to effect forced lubrication of said trunnions of said gears, wherein said branched communication passages comprise first communication passages which open at the closed end of said suction passage adjacent to the inlet to said low pressure passage, and second communication passages which open at the closed end of said low pressure passage whereby the liquid under low pressure trapped or forced into said first and second communication passages may be directed toward said liquid channelling means which effects the forced lubrication of said trunnions of said gears.

3. A combination as defined in claim 2, wherein said liquid channelling means comprises chambers defined at the free end of each of said trunnions, and lubrication oil passages communicated with said chambers, respectively, and extended through said bearing members axially thereof.

4. A combination as defined in claim 3, wherein said liquid channelling means further comprises return flow means for communicating said lubrication oil passages with said low pressure liquid inlet passage.

5. A combination as defined in claim 4, wherein said return flow means communicates said lubrication oil passages with said low pressure liquid inlet passage through annular grooves or passages defined between said trunnions and their bearing members.

* * * * *